US009079727B2

(12) United States Patent
Nakagawa

(10) Patent No.: US 9,079,727 B2
(45) Date of Patent: Jul. 14, 2015

(54) SHEET FEEDING DEVICE AND IMAGE FORMING APPARATUS

(71) Applicant: CANON KABUSHIKI KAISHA, Tokyo (JP)

(72) Inventor: Tomohito Nakagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/319,114

(22) Filed: Jun. 30, 2014

(65) Prior Publication Data

US 2015/0021850 A1 Jan. 22, 2015

(30) Foreign Application Priority Data

Jul. 19, 2013 (JP) ..... 2013-151085

(51) Int. Cl.

| | |
|---|---|
| ***B65H 1/26*** | (2006.01) |
| ***B65H 5/00*** | (2006.01) |
| ***B65H 9/02*** | (2006.01) |
| ***B65H 1/08*** | (2006.01) |

(52) U.S. Cl.

CPC .. *B65H 5/00* (2013.01); *B65H 1/08* (2013.01); *B65H 1/26* (2013.01); *B65H 9/02* (2013.01); *B65H 2511/12* (2013.01); *B65H 2701/1131* (2013.01)

(58) Field of Classification Search

CPC ..... B65H 1/26; B65H 2511/12

USPC ..... 271/171, 240

See application file for complete search history.

(56) References Cited

U.S. PATENT DOCUMENTS

| | | | | |
|---|---|---|---|---|
| 5,455,667 | A | 10/1995 | Hiroi et al. | |
| 5,552,859 | A | 9/1996 | Nakagawa et al. | |
| 5,621,501 | A | 4/1997 | Matsuo et al. | |
| 5,833,230 | A | 11/1998 | Nakagawa et al. | |
| 6,021,305 | A | 2/2000 | Sato et al. | |
| 6,038,424 | A | 3/2000 | Nakagawa | |
| 6,098,977 | A | 8/2000 | Sato et al. | |
| 6,131,898 | A | 10/2000 | Hiroi et al. | |
| 7,034,925 | B2 | 4/2006 | Kamiyama et al. | |
| 7,913,998 | B2 * | 3/2011 | Okuda et al. | 271/171 |
| 7,918,448 | B2 * | 4/2011 | Suzuki et al. | 271/171 |
| 8,083,223 | B2 * | 12/2011 | Ikeda | 271/145 |
| 8,342,515 | B2 * | 1/2013 | Iwata | 271/171 |
| 2007/0194514 | A1 * | 8/2007 | Ikeda | 271/97 |
| 2008/0315498 | A1 * | 12/2008 | Ikeda | 271/18 |
| 2011/0285075 | A1 * | 11/2011 | Nakamura et al. | 271/109 |

FOREIGN PATENT DOCUMENTS

JP 2006-327805 A 12/2006

* cited by examiner

*Primary Examiner* — Patrick Cicchino

(74) *Attorney, Agent, or Firm* — Fitzpatrick, Cella, Harper & Scinto

(57) ABSTRACT

Provided are a sheet feeding device and an image forming apparatus for feeding small-size sheets without causing skew and paper jamming. On a downstream side of far-side and near-side side regulating members in a sheet feeding direction, far-side and near-side auxiliary side regulating members are provided so as to be movable in a width direction. When each of sheets has a length capable of being regulated by the far-side and near-side side regulating members in the width direction, the far-side and near-side auxiliary side regulating members are moved to retreat positions. When a sheet has a length shorter than the length capable of being regulated by the far-side and near-side side regulating members in the width direction, the far-side and near-side auxiliary side regulating members are moved to protruding positions, at which they protrude in the width direction with respect to the far-side and near-side side regulating portions.

10 Claims, 12 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly, to configurations of side edge regulating portions for regulating positions of side edges of sheets contained in a sheet containing unit.

2. Description of the Related Art

Nowadays, there is widely used an image forming apparatus such as a copier, a printer, and a facsimile, in which a sheet feeding device is used to feed a sheet to an image forming unit to form an image. As the sheet feeding device, there is a device, in which a plate-like sheet stacking unit for stacking sheets is provided in a sheet containing unit so as to be freely raised and lowered. When replenishing the sheets, the sheet stacking unit is lowered. When feeding the sheets, the sheet stacking unit is raised to move an upper surface of the stack of sheets to a position at which the sheets can be fed by a feed roller located above.

In this sheet feeding device, on the sheet containing unit, a trailing edge regulating portion, which regulates positions of upstream edges (hereinafter referred to as trailing edges) in a sheet feeding direction of the sheets stacked on the sheet stacking unit, is slidably provided so that sheets having different sizes can be contained in the sheet containing unit. Moreover, in the sheet feeding device, there is provided a side edge regulating portion, which regulates side edge positions of the sheets in a direction (hereinafter referred to as a width direction) orthogonal to the sheet feeding direction of the sheets. The side edges of the sheets are regulated by the side edge regulating portion, and the trailing edges of the sheets are regulated by the trailing edge regulating portion. In such a way, the position of each of the sheets is regulated at a predetermined position.

In such a conventional sheet feeding device, the sheet stacking unit is set at such a size that sheets with a maximum size, on which the image forming apparatus is capable of forming an image, are stacked on the sheet stacking unit. Therefore, in order that the side edge regulating portion can move in the width direction when the sheets with a smaller size than the maximum size are stacked on the sheet stacking unit, a cutout portion, which allows the movement of the side edge regulating portion, is formed in the sheet stacking unit. When the cutout portion is formed, strength of the sheet stacking unit is lowered, and accordingly, a formation amount of the cutout portion is limited. Along with such a limitation, a movement amount of the side edge regulating portion in the width direction is also limited. When the movement amount of the side edge regulating portion is limited, there is a risk in that side edge positions of small-size sheets, such as envelops and postcards, cannot be regulated by the side edge regulating portion. Therefore, as disclosed in Japanese Patent Application Laid-Open No. 2006-327805, there is a device, in which an auxiliary side edge regulating portion for regulating the small-size sheets is provided in the side edge regulating portion.

FIGS. 12A and 12B illustrate a configuration of a sheet containing unit of a sheet feeding device. In FIGS. 12A and 12B, side edge regulating members 510 and 511 are provided in a sheet storage 507 so as to be movable in the width direction, and a trailing edge regulating plate 514 is provided so as to be movable in the sheet feeding direction. A feed roller 501 feeds sheets P. On a downstream side of this feed roller 501 in the sheet feeding direction, a separation/feed roller (not shown), which separates the sheets fed by the feed roller 501 one by one, is provided. An intermediate plate 508 is provided in the sheet storage 507 so as to be capable of being raised and lowered. The sheets P are stacked on the intermediate plate 508, and the intermediate plate 508 presses the stacked sheets P against the feed roller 501.

On downstream ends of the side edge regulating members 510 and 511 in the sheet feeding direction, auxiliary side edge regulating members 512 and 513, which regulate edges of the sheets P having a small size, are provided so as to be pivotable about pivot shafts 512*a* and 513*a* serving as fulcrums. When regulating side edge positions of the sheets P having a small size, the auxiliary side edge regulating members 512 and 513 are moved to set positions indicated by the solid lines. When regulating side edge positions of the sheets having a regular size, the auxiliary side edge regulating members 512 and 513 are pivoted and moved to retreat positions indicated by the chain double-dashed lines.

In the sheet feeding device of such a comparative example, which includes the auxiliary side edge regulating members 512 and 513, it is only one-side surfaces 522 and 523 of the auxiliary side edge regulating members 512 and 513 that regulate the side edge positions of the sheets P in the auxiliary side edge regulating members 512 and 513. Therefore, when the auxiliary side edge regulating members 512 and 513 are located at the set positions, in regions indicated by the arrows 600 on the downstream side in the conveyance direction as illustrated in FIG. 12A, the auxiliary side edge regulating members 512 and 513 cannot be brought into contact with the sides edges of the sheets P and cannot regulate the side edge positions. That is, when setting the small-size sheets P, the side edge positions of the sheets P can be regulated by the auxiliary side edge regulating members 512 and 513. However, on the downstream side in the sheet feeding direction, guide-free regions (indicated by the dotted lines 532 and 533), in which the side edges of the sheets P cannot be regulated, are generated.

Due to the guide-free regions indicated by the dotted lines 532 and 533, the following problem occurs. Usually, in the sheet feeding device, a separation unit is arranged so as to separate the sheets, which are fed by the feed roller, one by one. In many cases, a separation pad and a separation roller are used for this separation unit. The separation pad and the separation roller separate the sheets from one another by friction force, and accordingly, there is a risk in that the separation pad and the separation roller may apply resistance to leading edges of the sheets fed thereinto and skew the leading edges of the sheets.

In general, in order to prevent the skew of the sheets by the separation unit, the side edge regulating members are arranged at positions as close to the separation unit as possible, to thereby regulate the sheets. However, when the guide-free regions are present, the skew of the sheets due to the separation unit cannot be regulated sufficiently. Hence, a frequency of the skew of the sheets due to the guide-free regions is increased, thus causing a problem in that the sheets cannot be fed stably.

SUMMARY OF THE INVENTION

The present invention has been made in view of the circumstances as described above. It is an object of the present invention to provide a sheet feeding device and an image forming apparatus, which are capable of stably feeding even small-size sheets.

According to one embodiment of the present invention, there is provided a sheet feeding device, including: a sheet feeding unit configured to feed a sheet; a sheet containing unit configured to contain the sheet; a sheet stacking unit configured to stack the sheet and provided in the sheet containing unit so as to be capable of being raised and lowered; a pair of side edge regulating portions provided to be opposed to each other in the sheet containing unit so as to regulate side edge positions of the stacked sheet in a width direction orthogonal to a sheet feeding direction, at least one of the pair of side edge regulating portions being movable in the width direction; auxiliary side edge regulating portions provided on downstream ends of the pair of side edge regulating portions in the sheet feeding direction, and configured to form flush surfaces along the sheet feeding direction together with the pair of side edge regulating portions so as to regulate the side edge positions, the auxiliary side edge regulating portions being movable to retreat positions and protruding positions, at which the auxiliary side edge regulating portions protrude in the width direction with respect to the pair of side edge regulating portions; and support units configured to support the auxiliary side edge regulating portions so that abutment surfaces of the auxiliary side edge regulating portions, which abut against the sheet, are movable in the width direction with respect to the pair of side edge regulating portions in a state of being parallel to the sheet feeding direction.

Further features of the present invention will become apparent from the following description of exemplary embodiments with reference to the attached drawings.

DESCRIPTION OF THE EMBODIMENTS

Embodiments of the present invention are described below in detail with reference to the drawings.

Figure 1:
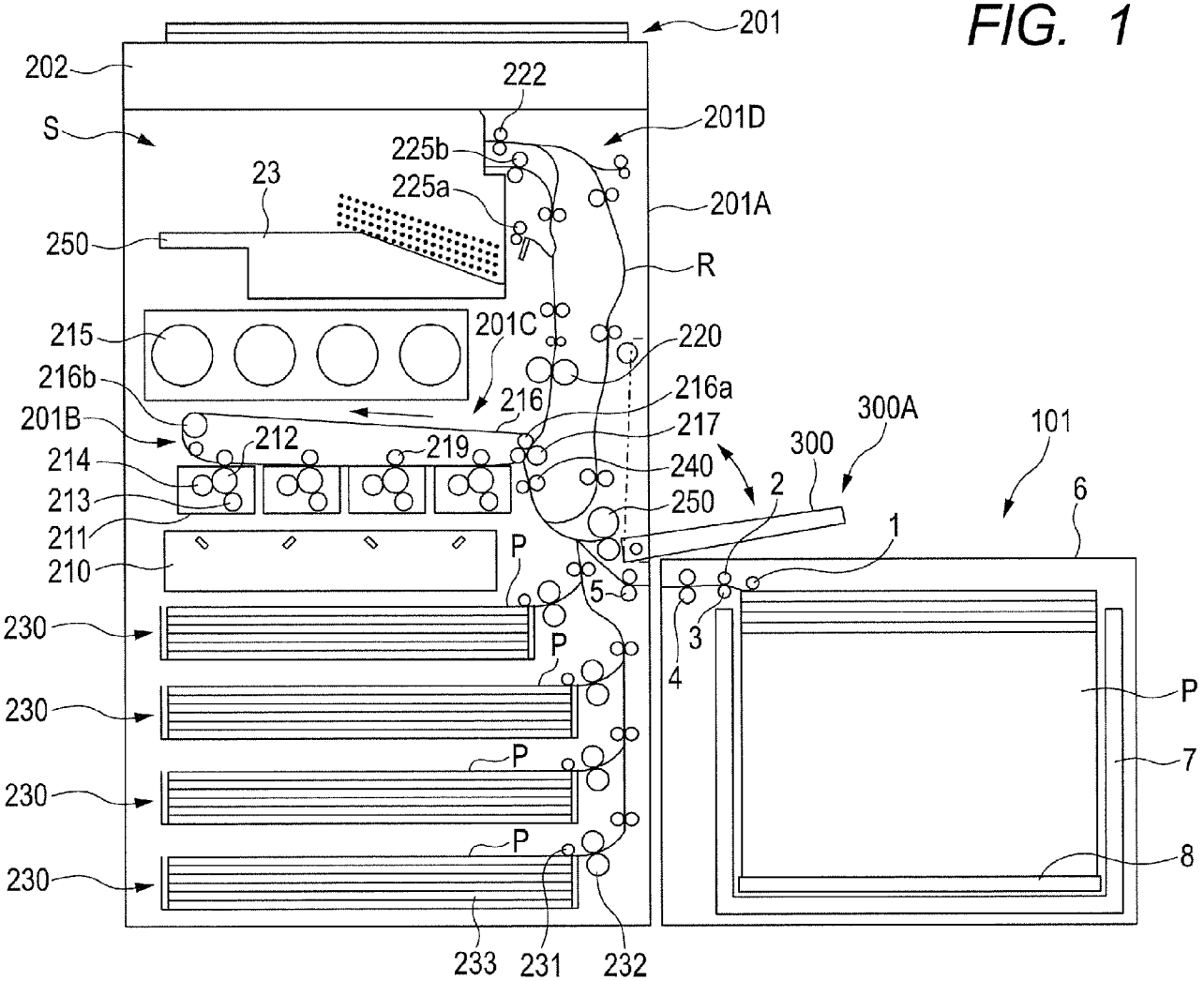
FIG. 1 illustrates a configuration of a full-color laser beam printer that is an example of an image forming apparatus including a sheet feeding device according to a first embodiment of the present invention.

FIG. 1 illustrates a configuration of a full-color laser beam printer that is an example of an image forming apparatus including a sheet feeding device according to a first embodiment of the present invention. In FIG. 1, a full-color laser beam printer (hereinafter referred to as a printer) 201 includes a printer main body 201A serving as an image forming apparatus main body, an image forming unit 201B for forming an image on a sheet, and a fixing portion 220. An image reading device 202 is an upper device mounted substantially horizontally above the printer main body 201A. A delivery space S for sheet delivery is secured between this image reading device 202 and the printer main body 201A. In addition, there are toner cartridges 215.

The image forming unit 201B is a four-drum full-color type image forming unit, and includes a laser scanner 210, and four process cartridges 211 for forming toner images of four colors, which are yellow (Y), magenta (M), cyan (C), and black (K). Each of the process cartridges 211 includes a photosensitive drum 212, a charger 213 serving as a charging unit, a developing device 214 serving as a developing unit, and a cleaner serving as a cleaning unit (not shown). The image forming unit 201B includes an intermediate transfer unit 201C arranged above the process cartridges 211.

The intermediate transfer unit 201C includes an intermediate transfer belt 216 looped around a drive roller 216*a* and a tension roller 216*b*. Moreover, the intermediate transfer unit 201C includes primary transfer rollers 219, which are provided on an inner side of the intermediate transfer belt 216, and abut on the intermediate transfer belt 216 at positions opposed to the respective photosensitive drums 212. The intermediate transfer belt 216 is formed of a film-like member, and is arranged so as to be brought into contact with the respective photosensitive drums 212. The intermediate transfer belt 216 rotates in the arrow direction by the drive roller 216*a* driven by a drive unit (not shown). Positive transfer biases are applied to the intermediate transfer belt 216 by the primary transfer rollers 219, and thus the toner images of the respective colors on the photosensitive drums, which have a negative polarity, are sequentially transferred onto the intermediate transfer belt 216 in a multi-layer manner. In such a way, a color image is formed on the intermediate transfer belt.

At a position of the intermediate transfer unit 201C, which is opposed to the drive roller 216*a*, there is provided a secondary transfer roller 217 serving as a secondary transfer portion for transferring, onto a sheet P, the color image formed on the intermediate transfer belt. The fixing portion 220 is arranged above the secondary transfer roller 217, and in an upper left portion of the fixing portion 220, there are arranged a first delivery roller pair 225*a*, a second delivery roller pair 225*b*, and a duplex reversing portion 201D serving as a reversing delivery portion. In this duplex reversing portion 201D, there are provided a reversing roller pair 222 serving as sheet reversing conveyance rollers capable of forward and reverse rotations, and a reconveyance path R for reconveying a sheet having an image formed on one side thereof, to the image forming unit 201B.

Below the printer 201, sheet feeding devices 230 are arranged at four stages. Each of the sheet feeding devices 230 feeds the sheets P, which are stacked on a sheet feed cassette 233, one by one by a feed roller 231, and thereafter, separates the sheets P one by one by a separation roller 232, and conveys the sheets P to registration rollers 240. Thereafter, the registration rollers 240 convey each of the sheets P to the secondary transfer portion at a predetermined timing.

On a right side surface of the printer main body 201A, a manual sheet feed unit 300A, which includes an open/close tray 300 capable of manual feed, is provided. Sheets set in the open/close tray 300 are conveyed by manual sheet feed rollers 250 toward the registration rollers 240 inside the printer main body. On a side of the printer main body 201A, a large-capacity paper deck 101, which is a sheet feeding device capable of feeding a large number of the sheets P, is arranged.

Next, image forming operations of the printer 201 are described. First, when image information of an original is read by the image reading device 202, this image information is subjected to image processing, is thereafter converted into an electrical signal, and is transmitted to the laser scanner 210 of the image forming unit 201B. Note that, in some cases, the image information is input to the image forming unit 201B from an external device such as a personal computer (not shown).

In the image forming unit 201B, surfaces of the photosensitive drums 212 of the respective process cartridges 211 are scanned by laser beams emitted from the laser scanner 210, which correspond to image information of yellow, magenta, cyan, and black component colors. In such a way, the surfaces of the photosensitive drums 212, which are uniformly charged with predetermined polarity/potential by the chargers 213, are sequentially exposed, and electrostatic latent images of yellow, magenta, cyan, and black are sequentially formed on the photosensitive drums of the respective process cartridges 211.

Thereafter, the electrostatic latent images are visualized by being developed by toners of the respective colors that are yellow, magenta, cyan, and black. In addition, by primary transfer biases applied to the primary transfer rollers 219, the toner images of the respective colors on the photosensitive drums are sequentially transferred onto the intermediate transfer belt 216 while being superimposed on one another. In such a way, the toner images are formed on the intermediate transfer belt 216. Note that, the toner, which has remained on the photosensitive drums 212 after the transfer of the toner images, is removed by cleaners (not shown).

Simultaneously with this toner image forming operation, each of the sheets P received in the sheet feed cassette 233 is fed by the sheet feeding device 230, and thereafter, the sheet P is conveyed to the registration rollers 240. Alternatively, when the feed of the sheet from the manual sheet feed unit 300A or the paper deck 101 is designated, the sheet P is conveyed from the manual sheet feed unit 300A or the paper deck 101 to the registration roller 240.

Skew of the sheet P is corrected by the registration rollers 240. After correcting the skew of the sheet P, the registration rollers 240 start to rotate at a timing synchronized with a moving speed of the toner images formed on the intermediate transfer belt 216. In such a way, the sheet P reaches the secondary transfer portion constructed by the drive roller 216*a* and the secondary transfer roller 217. Thereafter, at the secondary transfer portion, the toner images are collectively transferred onto the sheet P by a secondary transfer bias applied to the secondary transfer roller 217.

Next, the sheet P onto which the toner images are transferred is conveyed to the fixing portion 220, and the toners of the respective colors are fused and mixed under heat and pressure in the fixing portion 220. Thus, the toner images are fixed as a color image onto the sheet P. Thereafter, the sheet P onto which the image is fixed is delivered to the delivery space S by the first delivery roller pair 225*a* or the second delivery roller pair 225*b*, which is provided downstream of the fixing portion 220, and is stacked on a stacking portion 23 protruded to a bottom surface of the delivery space S.

When forming the image on both sides of the sheet, after the sheet P having the image formed on one side thereof passes through the fixing portion 220, a trailing edge thereof is allowed to pass through the fixing portion 220 by a switching portion (not shown) and the reversing roller pair 222. Thereafter, the reversing roller pair 222 rotates reversely at a predetermined timing so that the sheet P is reversed and conveyed to the reconveyance path R and is reconveyed to the registration rollers 240. Then, the image formation and the fixation are performed again for a back surface of the sheet P. Thereafter, the sheet P is delivered to the delivery space S by the first delivery roller pair 225*a* or the second delivery roller pair 225*b*, and is stacked on the stacking portion 23.

The paper deck 101 includes a sheet storage 7, in which a tray 8 for stacking the sheets thereon is provided so as to be capable of being raised and lowered, and a large number of the sheets P are received, and a feed roller 1 serving as a sheet feeding unit for feeding the sheets P stacked and received in the sheet storage 7. Moreover, the paper deck 101 includes a feed roller 2 serving as a separation unit, for separating the sheets P fed by the feed roller 1 and feeding the sheets P further downstream, and a retard roller 3 abutting on the feed roller 2, for separating the sheets P one by one.

For example, when two or more sheets are fed by the feed roller 1 and are nipped at a nip between the feed roller 2 and the retard roller 3, only the first sheet can be conveyed through such an operation that the retard roller 3 inhibits entrance of the second and subsequent sheets. Note that, the feed roller 1, the feed roller 2, and the retard roller 3 are rubber rollers in which members having a high friction coefficient, such as rubber, are rolled around outer circumferences thereof. The sheets P, which are separated one by one by the feed roller 2 and the retard roller 3, are further conveyed by draw rollers 4 to the printer main body 201A side.

Figure 2:
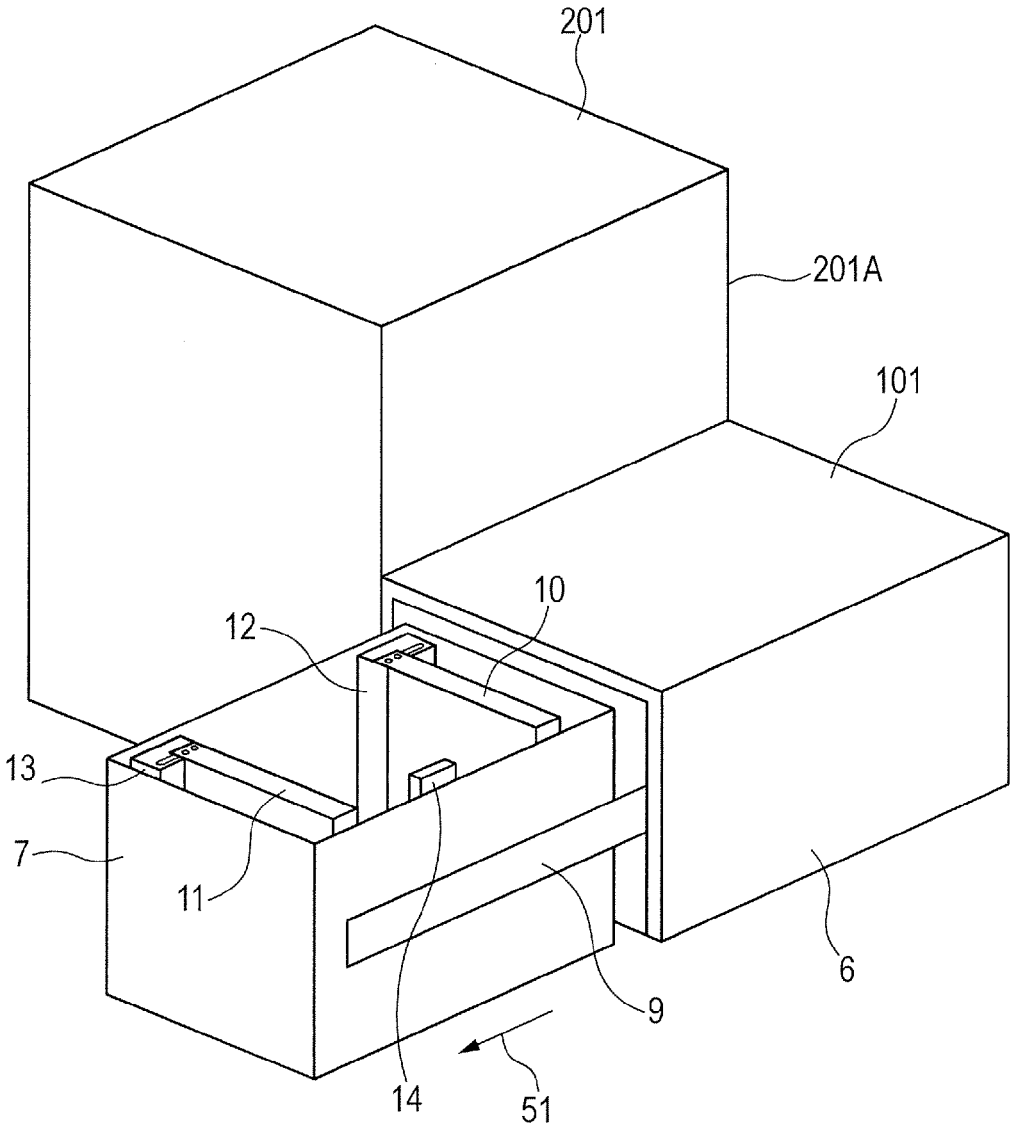
FIG. 2 illustrates a configuration of a paper deck that is the sheet feeding device.

As illustrated in FIG. 2, the sheet storage 7 of the paper deck 101 is provided so as to be drawable from a housing 6. FIG. 2 illustrates a state in which the sheet storage 7 is drawn from the housing 6 in a direction toward a near side, which is indicated by the arrow 51. Moreover, in FIG. 2, a slide rail 9 is arranged on an upstream wall surface of the sheet storage 7 serving as a sheet containing unit in a sheet feeding direction.

The slide rail 9 supports the sheet storage 7 so that the sheet storage 7 can be drawn from the housing 6. Another slide rail 9 is arranged on a downstream wall surface of the sheet storage 7. Side regulating members 10 and 11 serve as a pair of side edge regulating portions, which are provided in the sheet storage 7 so as to be movable in a width direction perpendicular to the sheet feeding direction, and configured to regulate the side edge positions of the sheets. A sheet trailing edge regulating plate 14 is provided so as to be movable along the sheet feeding direction, and configured to regulate trailing edge positions of the sheets.

When setting the sheets in the paper deck 101, the sheet storage 7 is drawn, and a work space for setting the sheets is secured. Thereafter, a bundle of the sheets is set from above on the tray 8 serving as a sheet stacking unit, which is provided in the sheet storage 7 so as to be capable of being raised and lowered, and configured to press the stacked sheets against the feed roller 1. Note that, the tray 8 is suspended by a wire (not shown), and is controllable to operate up and down by winding rotation drive of a wire pulley coupled to a drive motor.

When the sheets P are set, the side regulating members 10 and 11 and the sheet trailing edge regulating member 14 are next moved to positions in accordance with the size of the sheets P, to thereby regulate the position of the sheets. Thereafter, the sheet storage 7 is pushed into the housing 6. Then, when the sheet storage 7 is pushed to a predetermined position in the housing, the tray is raised. When an uppermost sheet of the sheets P stacked on the tray 8 is pressed against the feed roller 1 by a predetermined pressure, the tray 8 is stopped. Thereafter, when the sheets are sequentially fed and the number of the stacked sheets is reduced, the tray 8 is raised again, and is stopped when the uppermost sheet is pressed against the feed roller 1 by a predetermined pressure.

Figure 3:
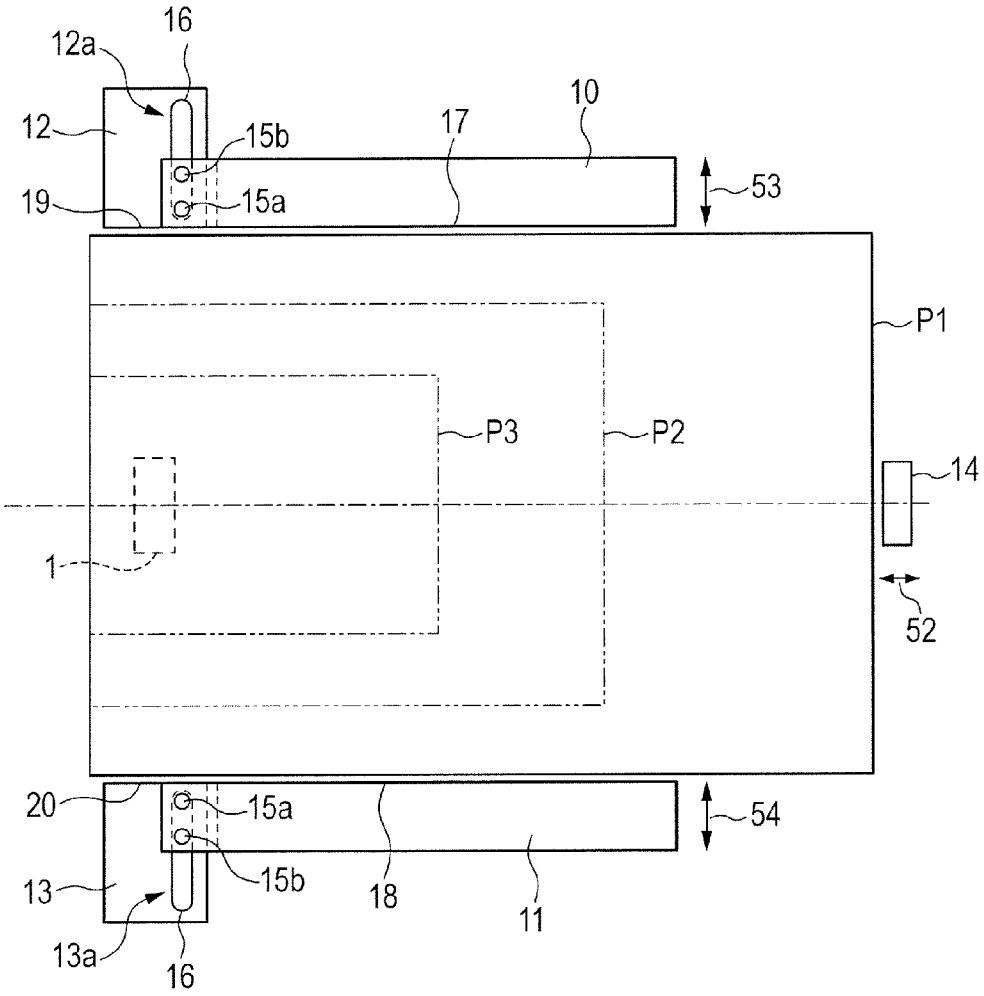
FIG. 3 illustrates a configuration of a sheet storage of the paper deck.

As illustrated in FIG. 3, the far-side side regulating member 10, which regulates the side edge position of each of the sheets P on a far side that is a downstream side in a pushing direction, includes a regulating surface 17 that abuts on a side edge of the sheet P on the far side. The near-side side regulating member 11, which regulates the side edge position of each of the sheets P on a near side that is an upstream side in the pushing direction, includes a regulating surface 18 that abuts on a side edge of the sheet P on the near side. The far-side and near-side side regulating members 10 and 11 are provided so as to be movable (slidable) in the width direction indicated by the arrows 53 and 54. The far-side and near-side side regulating members 10 and 11 are moved in the width direction in accordance with the size of the sheets P so that the side edges of the sheets P are brought into abutment on the regulating surfaces 17 and 18.

On a downstream end of the far-side side regulating member 10 in the sheet feeding direction, a far-side auxiliary side regulating member 12 is provided so as to be movable in the width direction. On a downstream end of the near-side side regulating member 11 in the sheet feeding direction, a near-side auxiliary side regulating member 13 is provided so as to be movable in the width direction. The far-side auxiliary side regulating member 12 includes an auxiliary regulating surface 19 that abuts on the side edge of the sheet P on the far side. The near-side auxiliary side regulating member 13 includes an auxiliary regulating surface 20 that abuts on the side edge of the sheet P on the near side. Those auxiliary side regulating members are used at the time of feeding a small-size sheet such as an envelope and a postcard.

The far-side and near-side auxiliary side regulating members 12 and 13, which are auxiliary side edge regulating portions, are provided at positions facing the feed roller 1. In such a way, when the sheet P is fed by the feed roller 1, even if the trailing edge of the sheet P passes through the feed roller 1, the sheet P is guided by the far-side and near-side auxiliary side regulating members 12 and 13.

FIG. 3 illustrates positions of the far-side and near-side auxiliary side regulating members 12 and 13 at the time of regulating the position of a sheet P1 having a relatively large size. At this time, the auxiliary regulating surface 19 of the far-side auxiliary side regulating member 12 and the regulating surface 17 of the far-side side regulating member 10 form a flush surface along the sheet feeding direction, and the auxiliary regulating surface 20 of the near-side auxiliary side regulating member 13 and the regulating surface 18 of the near-side side regulating member 11 form a flush surface along the sheet feeding direction. The far-side auxiliary side regulating member 12 is provided to the far-side side regulating member 10, and the near-side auxiliary side regulating member 13 is provided to the near-side side regulating member 11. Thus, the sheet can be guided at a long distance at the time of feeding the sheet. Accordingly, it is possible to obtain an excellent effect of preventing the skew of the sheet.

In each of the far-side and near-side side regulating members 10 and 11, two (multiple) pins 15*a* and 15*b* are formed along the width direction. In each of the far-side and near-side auxiliary side regulating members 12 and 13, a guide hole 16 for allowing the pins 15*a* and 15*b* to be engaged therewith is formed to extend in the width direction. In the first embodiment, support units 12*a* and 13*a* are constructed by the pins 15*a* and 15*b* and the guide holes 16, respectively. The support units 12*a* and 13*a* are configured to support the far-side and near-side auxiliary side regulating members 12 and 13 so as to be movable in the width direction with respect to the side regulating members 10 and 11, respectively.

By the support units 12*a* and 13*a*, the far-side and near-side auxiliary side regulating members 12 and 13 are slidable together with the far-side and near-side side regulating members 10 and 11 through intermediation of the pins 15*a* and 15*b*, respectively. Moreover, the far-side and near-side auxiliary side regulating members 12 and 13 are slidable in the width direction separately from the far-side and near-side side regulating members 10 and 11. Note that, the pins 15*a* and 15*b* may be formed in the far-side and near-side auxiliary side regulating members 12 and 13, respectively, and the guide holes 16 may be formed in the far-side and near-side side regulating members 10 and 11, respectively. That is, the pins 15*a* and 15*b* only need to be provided in one of the far-side and near-side auxiliary side regulating members 12 and 13 and the far-side and near-side side regulating members 10 and 11, respectively and the guide holes 16 only need to be provided in another thereof, respectively.

The far-side and near-side side regulating members 10 and 11 and the far-side and near-side auxiliary side regulating members 12 and 13 are moved so that positions of the large-size sheet P1 and a middle-size sheet P2, which are illustrated in FIG. 3, can be regulated in the width direction. Moreover, only the far-side and near-side auxiliary side regulating members 12 and 13 are moved so that a position of a small-size sheet P3, such as an envelope and a postcard, can be regulated in the width direction. Further, the trailing edge regulating member 14 is moved in the sheet feeding direction in accordance with the sheet size so that the trailing edge positions of the sheets can be regulated.

When sliding the far-side and near-side auxiliary side regulating members 12 and 13 in the width direction with respect to the far-side and near-side side regulating members 10 and 11 in accordance with the sheet size, respectively, it is necessary to hold the far-side and near-side auxiliary side regulating members 12 and 13 at positions corresponding to the sheet size. In this embodiment, as illustrated in FIGS. 4A and 4B, as holding units for holding the far-side and near-side auxiliary side regulating members 12 and 13, leaf springs 80, which are elastic members including protrusions 78, are arranged in the guide holes 16, respectively.

Figure 4A:
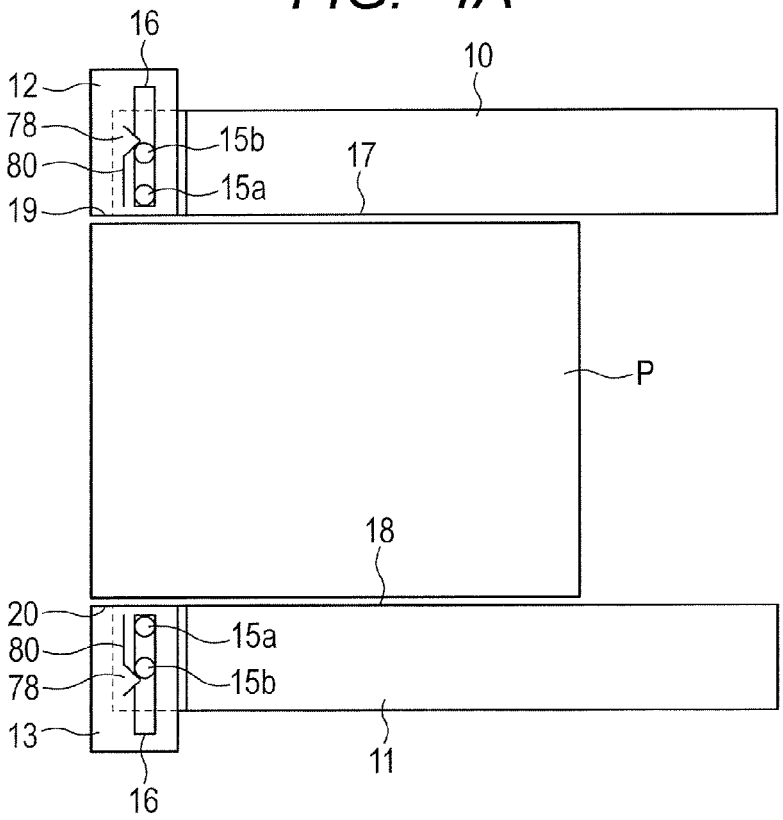
FIG. 4A illustrates sheet regulating positions of far-side and near-side auxiliary side regulating positions and far-side and near-side side regulating members, which are provided in the sheet storage.

FIG. 4A illustrates a state in which the far-side and near-side auxiliary side regulating members 12 and 13 are located at retreat positions, at which the far-side and near-side auxiliary side regulating members 12 and 13 form flush surfaces along the sheet feeding direction together with the far-side and near-side side regulating members 10 and 11, respectively. At this time, each of the protrusions 78 of the leaf springs 80 is elastically engaged with the pin 15*b* of the two pins 15*a* and 15*b*, which is located at a position apart from the sheet P. Thereby, movement of each of the far-side and near-side auxiliary side regulating members 12 and 13 in the width direction to apart from the sheet P can be regulated. As a result, the skew of the sheet P at the time of feeding the sheet can be prevented.

Figure 4B:
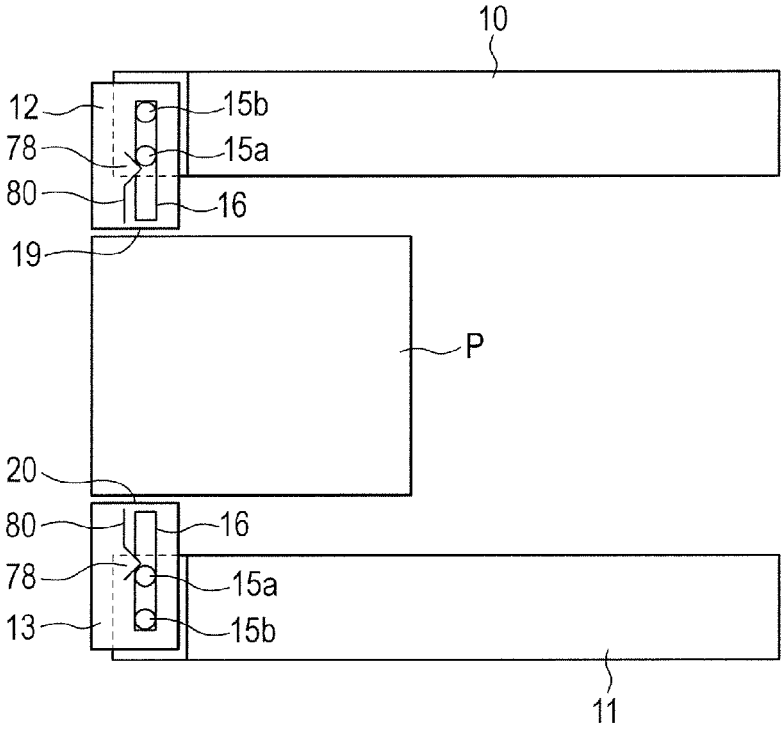
FIG. 4B illustrates sheet regulating positions of the far-side and near-side auxiliary side regulating positions and the far-side and near-side side regulating members, which are provided in the sheet storage.

FIG. 4B illustrates a state in which the far-side and near-side auxiliary side regulating members 12 and 13 are located at regulating positions (protruding positions), at which the far-side and near-side auxiliary side regulating members 12 and 13 protrude with respect to the far-side and near-side side regulating members 10 and 11 in the width direction, respectively. At this time, each of the protrusions 78 of the leaf springs 80 is elastically engaged with the pin 15*a* of the two pins 15*a* and 15*b*, which is located at a position close to the sheet P. Thereby, movement of each of the far-side and near-side auxiliary side regulating members 12 and 13 in the width direction approaching the sheet P can be regulated.

By using the leaf springs 80 as in the first embodiment, the far-side and near-side auxiliary side regulating members 12 and 13 can be stably held at the retreat positions illustrated in FIG. 4A and the regulating positions illustrated in FIG. 4B, and in addition, a click feeling can be given. Holding force of each of the leaf springs 80 is set to such an extent that a user can move the far-side and near-side auxiliary side regulating members 12 and 13.

Figure 5A:
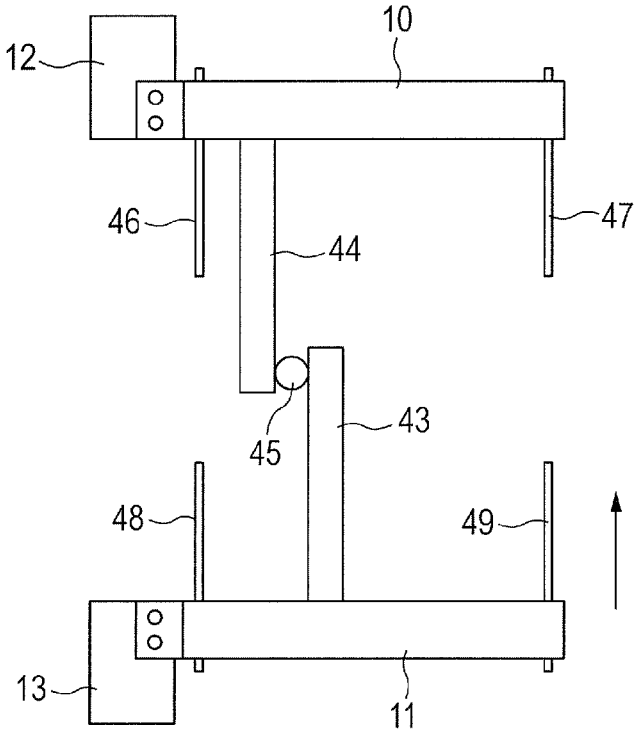
FIG. 5A illustrates a slide mechanism of the far-side and near-side side regulating members.
Figure 5B:
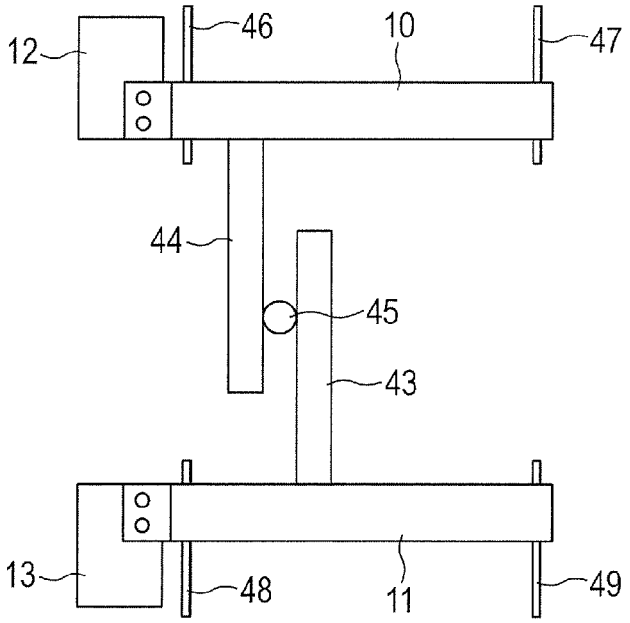
FIG. 5B illustrates the slide mechanism of the far-side and near-side side regulating members.

As illustrated in FIGS. 5A and 5B, racks 43 and including rack gears are fixed onto the far-side and near-side side regulating members 10 and 11, respectively. On a bottom surface of the sheet storage 7, a pinion gear 45, which serves as a slide mechanism of the far-side and near-side side regulating members 10 and 11 together with the racks 43 and 44, is provided. The racks 44 and 43 of the far-side and near-side side regulating members 10 and are coupled to each other by the pinion gear 45. Thereby, for example, when the near-side side regulating member 11 located at a position illustrated in FIG. 5A is moved in the arrow direction, the far-side side regulating member 10 also moves in conjunction therewith. Then, the far-side and near-side side regulating members 10 and 11 move to positions illustrated in FIG. 5B. Thereby, the far-side and near-side side regulating members 10 and 11 can be easily moved to the positions corresponding to the sheet size.

Figure 6:
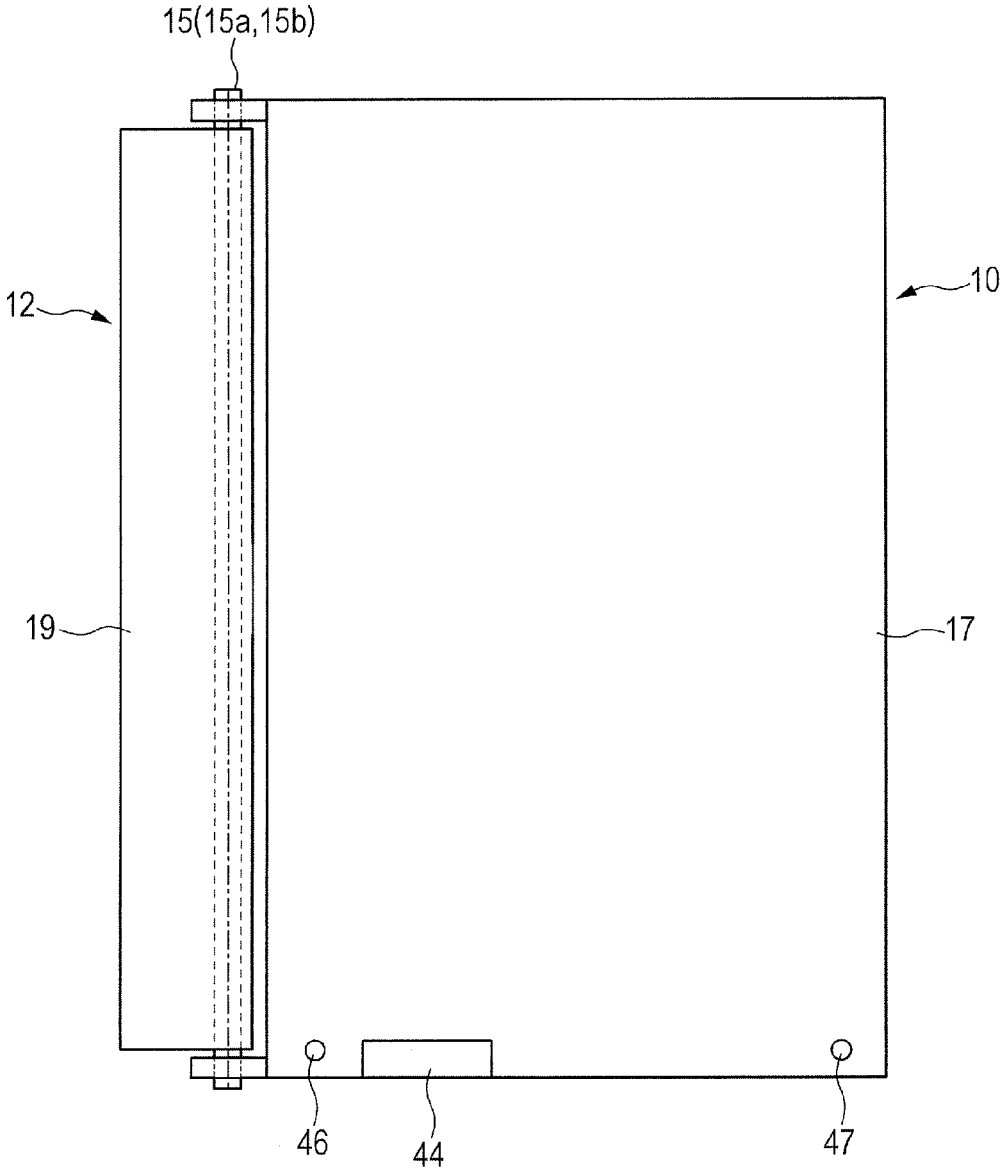
FIG. 6 illustrates a configuration for guiding slides of the far-side and near-side side regulating members.

In FIGS. 5A and 5B, slide guide shafts 46 and 47 are provided on the bottom surface of the sheet storage 7, and configured to guide the movement of the far-side side regulating member 10 in the width direction. Slide guide shafts 48 and 49 are provided on the bottom surface of the sheet storage 7, and configured to guide the movement of the near-side side regulating member 11 in the width direction. In the first embodiment, the slide guide shafts 46 and 47 are inserted through a lower end of the far-side side regulating member 10 as illustrated in FIG. 6. Thereby, the far-side side regulating member 10 moves in the width direction along the slide guide shafts 46 and 47. The rack 44 and the slide guide shafts 46 and 47 are arranged at such positions that the raising and lowering of the tray 8 are not hindered. The near-side side regulating member 11 also moves in the width direction along the slide guide shafts 48 and 49 with a similar configuration.

Figure 7A:
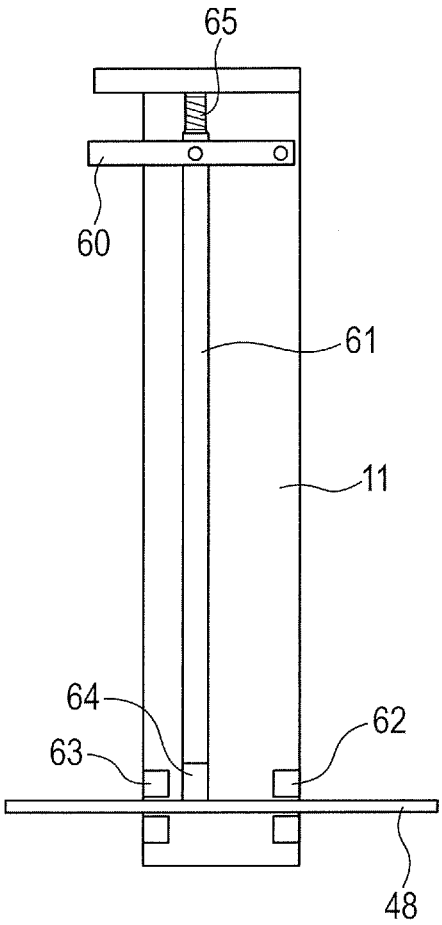
FIG. 7A illustrates a slide lock mechanism for locking the slides of the far-side and near-side side regulating members.
Figure 7B:
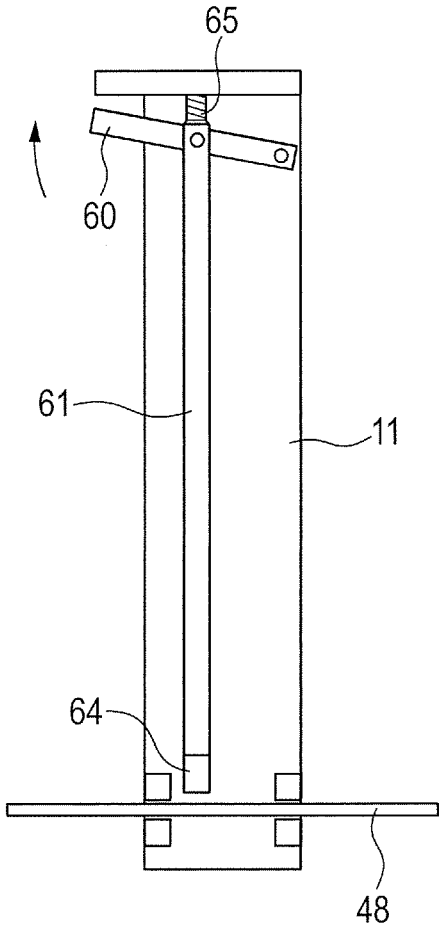
FIG. 7B illustrates the slide lock mechanism for locking the slides of the far-side and near-side side regulating members.

FIGS. 7A and 7B illustrate a slide lock mechanism for fixing the near-side side regulating member 11 at a position corresponding to the sheet size. The slide lock mechanism includes a push shaft 61 movable in an up-and-down direction, a lock portion 64 formed on a lower end of the push shat 61, a compression spring 65 for urging the push shaft 61 downward, and a knob 60 for raising and lowering the push shaft 61. In FIGS. 7A and 7B, guide bearings 62 and 63 of the slide guide shaft 48 are provided.

In general, in this slide lock mechanism, as illustrated in FIG. 7A, the push shaft 61 is pressed downward by a function of the compression spring 65, and the lock portion 64 is brought into pressure contact with the slide guide shaft 48. Thereby, the near-side side regulating member 11 is locked. When moving the near-side side regulating member 11, as illustrated in FIG. 7B, the knob 60 is operated in the arrow direction against the compression spring 65. Then, the lock portion 64 is spaced apart from the slide guide shaft 48, and thus the lock of the near-side side regulating member 11 is released.

After releasing the lock of the near-side side regulating member 11, the near-side side regulating member 11 is moved to the position corresponding to the sheet size. Thereby, the far-side side regulating member 10 also moves to the position corresponding to the sheet size in conjunction with the near-side side regulating member 11. Then, after setting of the far-side and near-side side regulating members 10 and 11 is completed, the knob 60 is released. Thereby, the push shaft 61 moves downward by the function of the compression spring 65, and the lock portion 64 is brought into pressure contact with the slide guide shaft 48 so that the near-side side regulating member 11 is locked. Thereby, the far-side and near-side side regulating members 10 and 11 can be locked at the positions corresponding to the sheet size.

Figure 8A:
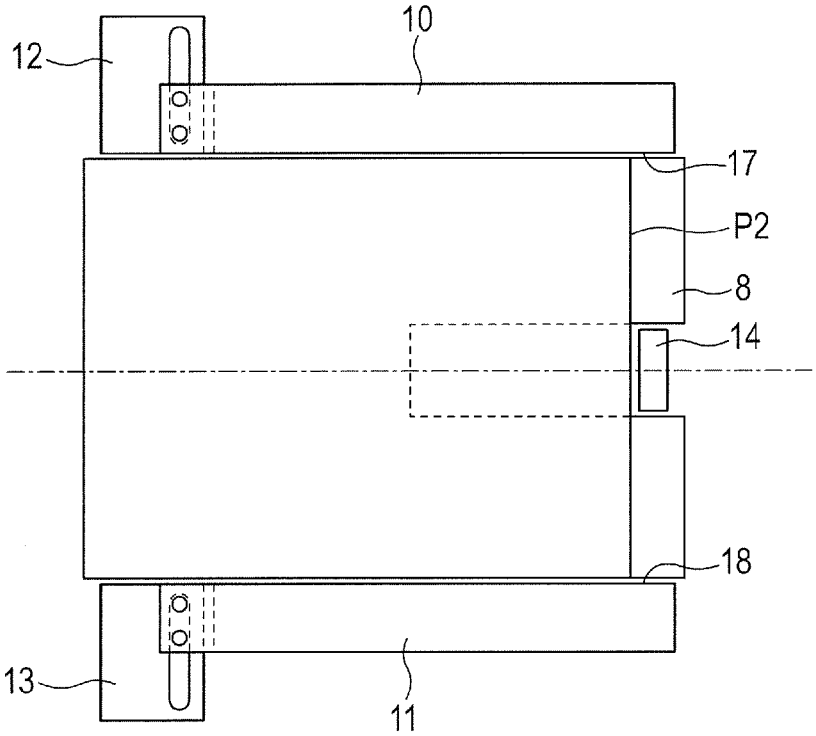
FIG. 8A illustrates positions of the far-side and near-side side regulating members and the far-side and near-side auxiliary side regulating members when setting a sheet.
Figure 8B:
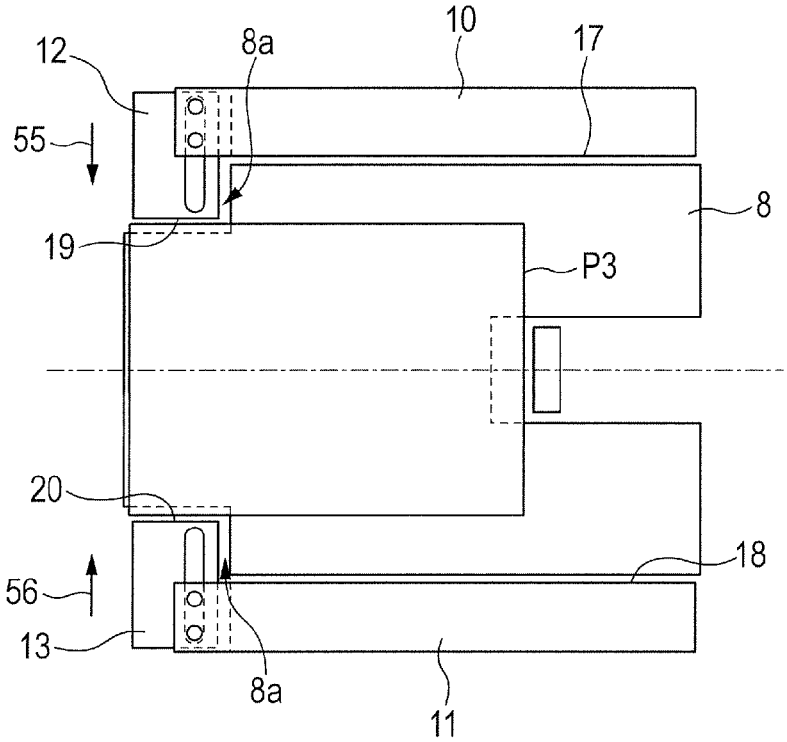
FIG. 8B illustrates the positions of the far-side and near-side side regulating members and the far-side and near-side auxiliary side regulating members when setting a sheet.

FIGS. 8A and 8B illustrate the positions of the far-side and near-side side regulating members 10 and 11 and the far-side and near-side auxiliary side regulating members 12 and 13 when the sheet is set. FIG. 8A illustrates a state in which the middle-size sheet P2 is set. When setting the middle-size sheet P2, the far-side and near-side side regulating members 10 and 11 are moved in the width direction integrally with the far-side and near-side auxiliary side regulating members 12 and 13, respectively. Then, edge surfaces of the sheet P2 are regulated, and a trailing edge surface of the sheet P2 is regulated by the trailing edge regulating member 14.

At this time, the far-side and near-side auxiliary side regulating members 12 and 13 are fixed at the retreat positions in a similar way to the case of setting the large-size sheet P1 in FIG. 3. That is, in the first embodiment, when the sheet P has a size equal to or larger than that of the sheet P2, the sheet P is regulated by the far-side and near-side auxiliary side regulating members 12 and 13 and the far-side and near-side side regulating members 10 and 11.

FIG. 8B illustrates a state of setting the small-size sheet P3. In the first embodiment, the tray 8 regulates the movement of the far-side and near-side side regulating members 10 and 11 in the width direction. Therefore, the far-side and near-side side regulating members 10 and 11 can be operated to slide only up to the positions for regulating the middle-size sheet P2, which are illustrated in FIG. 8A. Therefore, when setting the small-size sheet P3, the far-side and near-side auxiliary side regulating members 12 and 13 are operated to slide in directions indicated by the arrows 55 and 56. Then, the auxiliary regulating surfaces 19 and 20 are protruded with respect to the regulating surfaces 17 and 18 of the far-side and near-side side regulating members 10 and 11.

Figure 12A:
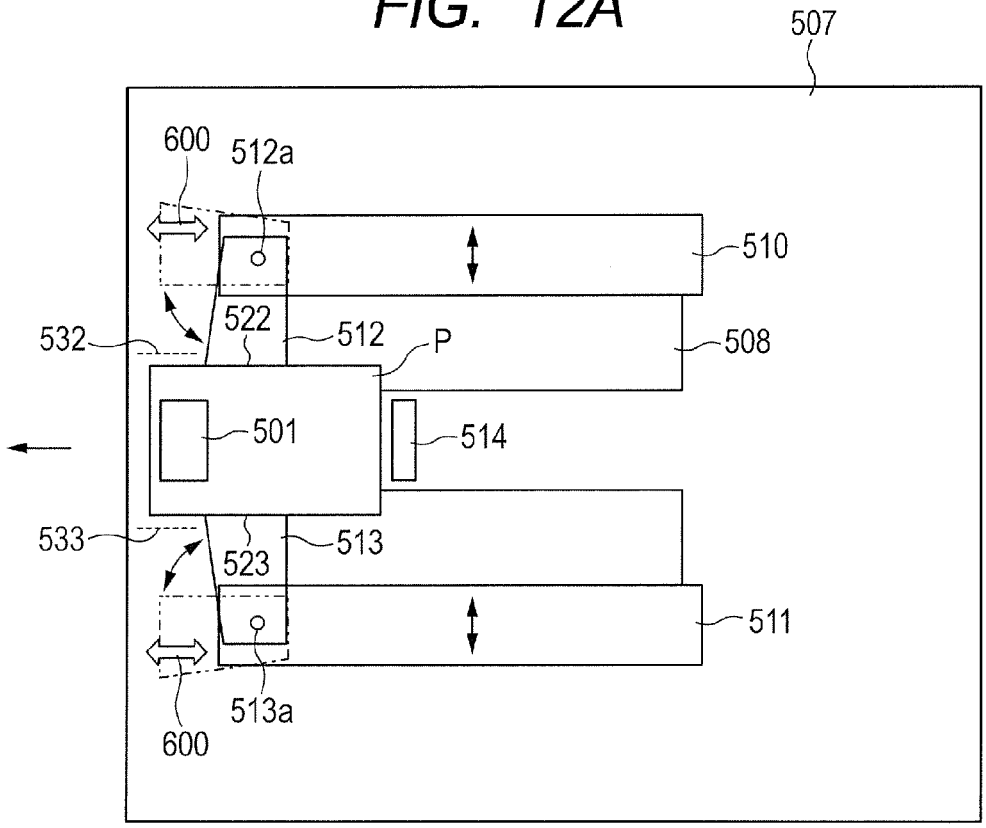
FIG. 12A illustrates a configuration of a sheet containing unit of a sheet feeding device of a comparative example.
Figure 12B:
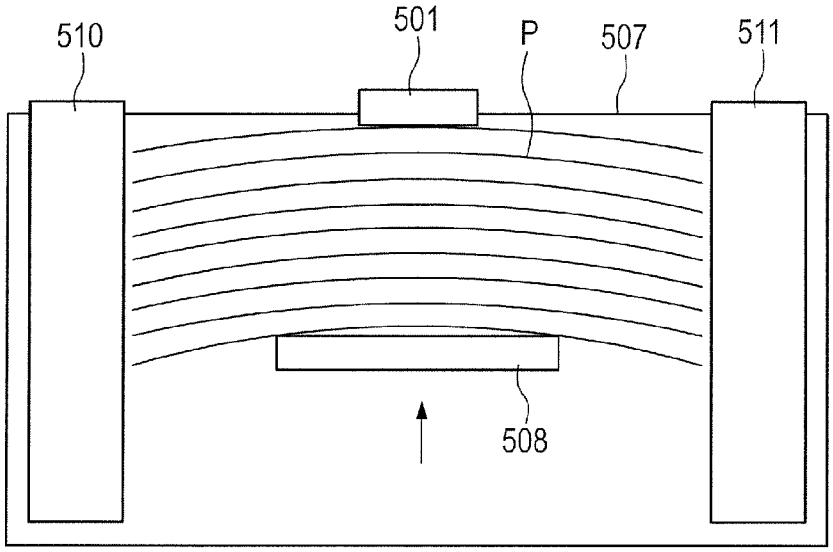
FIG. 12B illustrates the configuration of the sheet containing unit of the sheet feeding device of the comparative example.

When the far-side and near-side side regulating members 10 and 11 are slidable up to positions corresponding to the small-size sheet P3, in terms of layout, the area of the tray 8, which supports the sheets, is reduced. When the area of the tray 8, which supports the sheets, is reduced, as illustrated in FIG. 12B, end portions of the sheets hang down by self weight thereof at the time when the large-size sheets are stacked, and the sheets are not properly stacked on the tray 8. When the end portions of the sheets hang down, the sheets sag, and sagging regions thereof are caught on the tray 8 at the time of feeding the sheets, thus causing paper jamming.

In the first embodiment, a shape of a sheet stacking surface of the tray 8 is formed so that the sheets ranging from the large-size sheet P1 to the small-size sheet P3 can be stacked on the tray 8 without causing the sheets to hang down. That is, as illustrated in FIG. 8B, the tray 8 is formed into such a shape that the movement of the far-side and near-side side regulating members 10 and 11 in the width direction is regulated and the far-side and near-side side regulating members 10 and 11 is moved only up to the positions for regulating the middle-size sheet P2.

Cutouts 8*a* are partially formed in downstream ends of the sheet stacking surface of the tray 8 in the feeding direction. Thereby, at the time of setting the small-size sheet P3, under the state in which the movement of the far-side and near-side side regulating members 10 and 11 is regulated, the far-side and near-side auxiliary side regulating members 12 and 13 can be protruded with respect to the far-side and near-side side regulating members 10 and 11 in the width direction, respectively. As a result, when feeding the small-size sheet P3, the sheet edges are guided by the auxiliary regulating surfaces 19 and 20 serving as abutment surfaces of the far-side and near-side auxiliary side regulating members 12 and 13, respectively. Therefore, the skew of the sheets can be surely prevented.

In the first embodiment, when feeding the large-size sheet P1 and the middle-size sheet P2, the sheets P1 and P2 are guided by the far-side and near-side side regulating members 10 and 11 and the far-side and near-side auxiliary side regulating members 12 and 13. When feeding the small-size sheet P3 that cannot be guided by the far-side and near-side side regulating members 10 and 11, the far-side and near-side auxiliary side regulating members 12 and 13 are protruded. Thereby, the sheet P3 is guided.

The far-side and near-side auxiliary side regulating members 12 and 13 are provided at the positions facing the feed roller 1. Therefore, even when the trailing edge of the sheet P3 passes through the feed roller 1, the sheet P3 is guided by the far-side and near-side auxiliary side regulating members 12 and 13. Thereby, the sheet P3 can be prevented from being skewed on the downstream side of the tray 8 in the sheet feeding direction, that is, in the vicinity of the feed roller 1 and the vicinity of the feed roller 2.

As described above, in the first embodiment, when the sheet has a length capable of being regulated by the far-side and near-side side regulating members 10 and 11 in the width direction, the far-side and near-side auxiliary side regulating members 12 and 13 are moved to the retreat positions. When the length of the sheet in the width direction is shorter than the length capable of being regulated by the far-side and near-side side regulating members 10 and 11, the far-side and near-side auxiliary side regulating members 12 and 13 are moved to the protruding positions.

Thereby, regardless of the sheet size, when feeding the sheet, the sheet can be guided by the far-side and near-side auxiliary side regulating members 12 and 13 on the downstream side of the tray 8 in the sheet feeding direction. As a result, even when the small-size sheet, the sheet can be fed without causing the skew or the paper jamming.

Figure 9A:
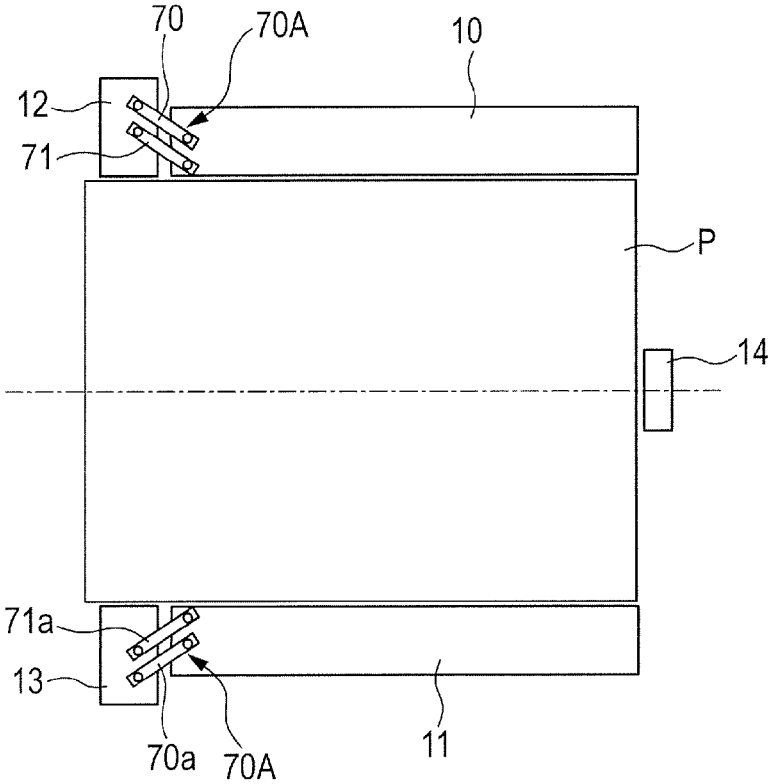
FIG. 9A illustrates far-side and near-side auxiliary side regulating positions and far-side and near-side side regulating portions, which are provided in a sheet feeding device according to a second embodiment of the present invention.
Figure 9B:
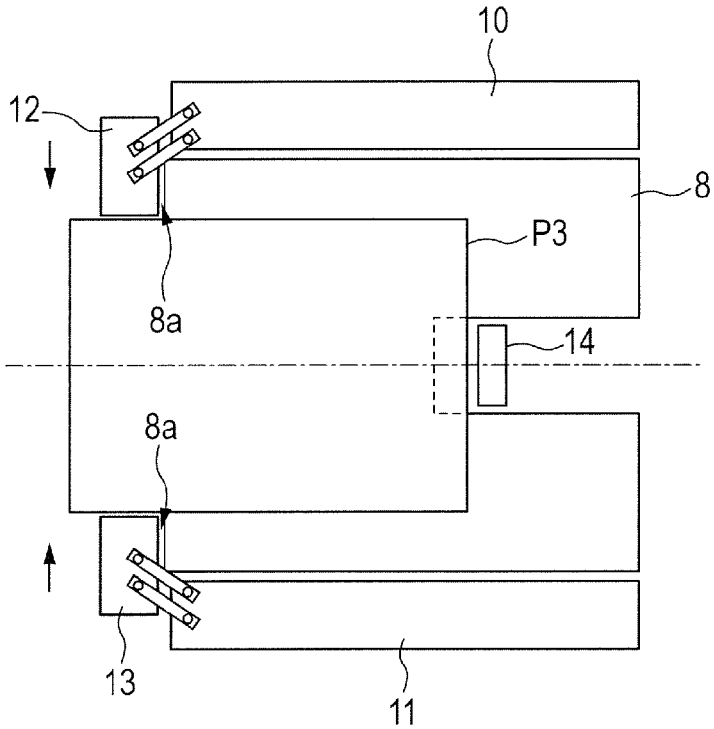
FIG. 9B illustrates the far-side and near-side auxiliary side regulating positions and the far-side and near-side side regulating members, which are provided in the sheet feeding device according to the second embodiment of the present invention.

Next, a second embodiment of the present invention is described. FIGS. 9A and 9B illustrate far-side and near-side auxiliary side regulating members and far-side and near-side side regulating members, which are provided in a sheet feeding device according to the second embodiment. In FIGS. 9A and 9B, the same reference symbols as those in FIG. 3 denote the same or corresponding portions.

In FIGS. 9A and 9B, link members 70 and 71 parallel to each other connect the far-side side regulating member 10 and the far-side auxiliary side regulating member to each other. Link members 70*a* and 71*a* parallel to each other connect the near-side side regulating member 11 and the near-side auxiliary side regulating member 13 to each other. The two parallel link members 70 and 71 and the two parallel link members 70*a* and 71*a* serve as parallel link mechanisms 70A. When receiving the large-size sheet P1, the far-side and near-side auxiliary side regulating members 12 and 13 are positioned at retreat positions illustrated in FIG. 9A. When receiving the small-size sheet P3, the far-side auxiliary side regulating member 12 and the near-side auxiliary side regulating member 13 are moved in the arrow directions illustrated in FIG. 9B, and are brought into abutment on the side edges of the sheet P3.

Figure 10A:
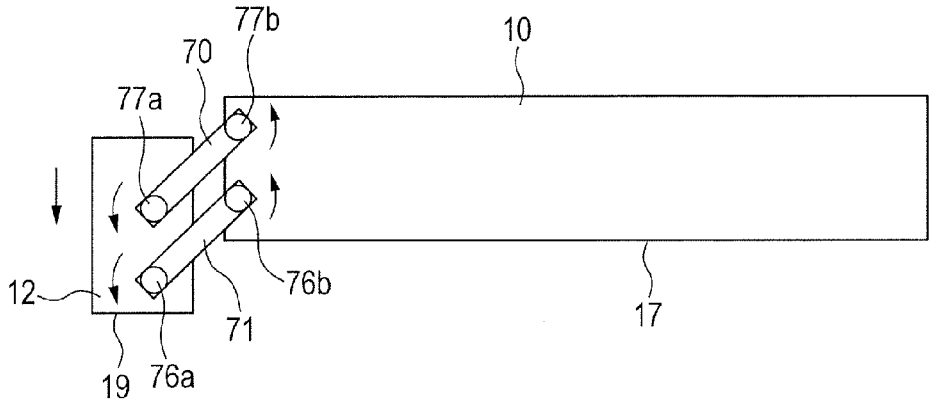
FIG. 10A illustrates operations of links that connect the far-side and near-side auxiliary side regulating positions and the far-side and near-side side regulating members to each other.
Figure 10B:
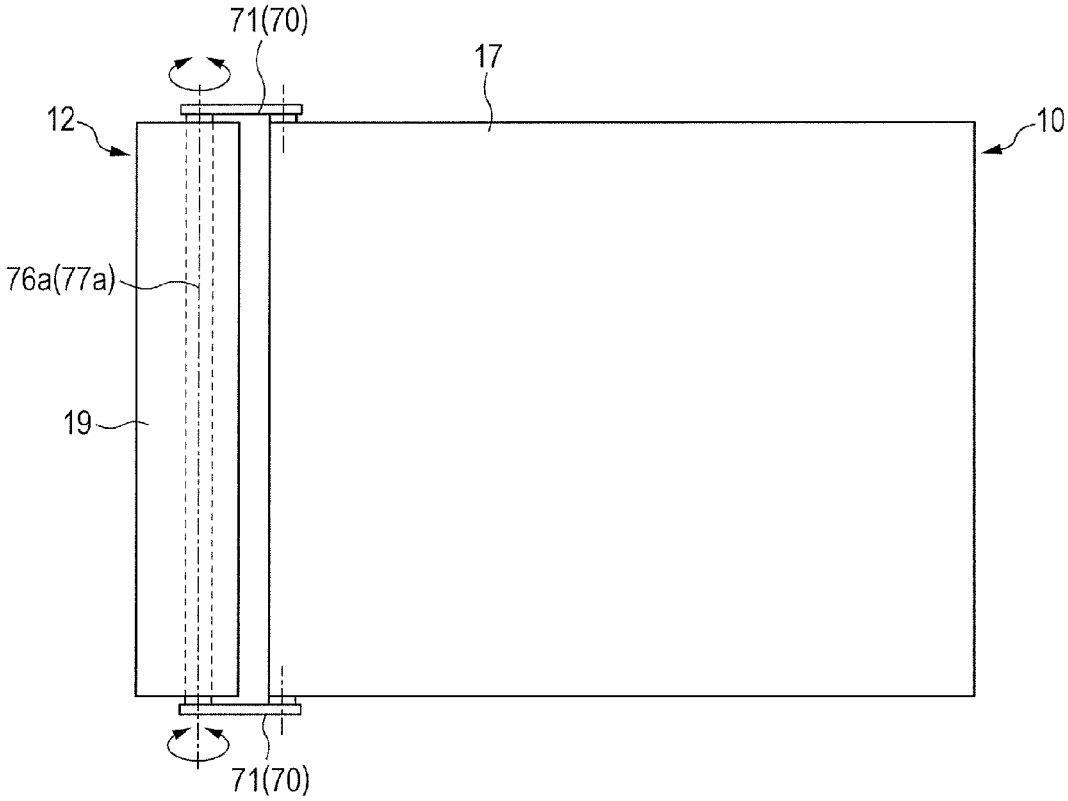
FIG. 10B illustrates the operations of the links that connect the far-side and near-side auxiliary side regulating positions and the far-side and near-side side regulating members to each other.

As illustrated in FIGS. 10A and 10B, the link member 70, which connects the far-side side regulating member 10 and the far-side auxiliary side regulating member to each other, includes a pivot shaft 77*a* on one end thereof and a pivot shaft 77*b* on another end thereof. The link member 71, which connects the far-side side regulating member 10 and the far-side auxiliary side regulating member to each other, includes a pivot shaft 76*a* on one end thereof and a pivot shaft 76*b* on another end thereof. In such a way, when the far-side auxiliary side regulating member 12 is operated in an arrow direction of FIG. 10A, the far-side auxiliary side regulating member 12 moves in the width direction while moving the link members 70 and 71 about the pivot shafts 76*a*, 76*b*, 77*a*, and 77*b*.

In the second embodiment, as illustrated in FIG. 10B, the link members 70 and 71 are provided on upper surfaces and lower surfaces of the far-side side regulating member 10 and the far-side auxiliary side regulating member 12. The pivot shafts 76*a* and 77*a* of the link members 70 and 71 in the vicinity of the far-side auxiliary side regulating member are allowed to pass through an inside of the far-side auxiliary side regulating member so that the upper and lower link members 70 and 71 are connected to each other.

Thereby, when operating the far-side auxiliary side regulating member 12, the upper link members 71 and 70 and the lower link members 71 and 70 move in conjunction with each other by the pivot shafts 76*a* and 77*a* in the vicinity of the far-side auxiliary side regulating member (auxiliary side edge regulating portion). As a result, the far-side auxiliary side regulating member 12 (the auxiliary regulating surface 19 thereof) can be surely moved in a parallel state to the sheet feeding direction. Therefore, the skew of the sheet can be surely prevented. The link members 70*a* and 71*a*, which connect the near-side side regulating member 11 and the near-side auxiliary side regulating member 13 to each other, also have a similar configuration.

Figure 11A:
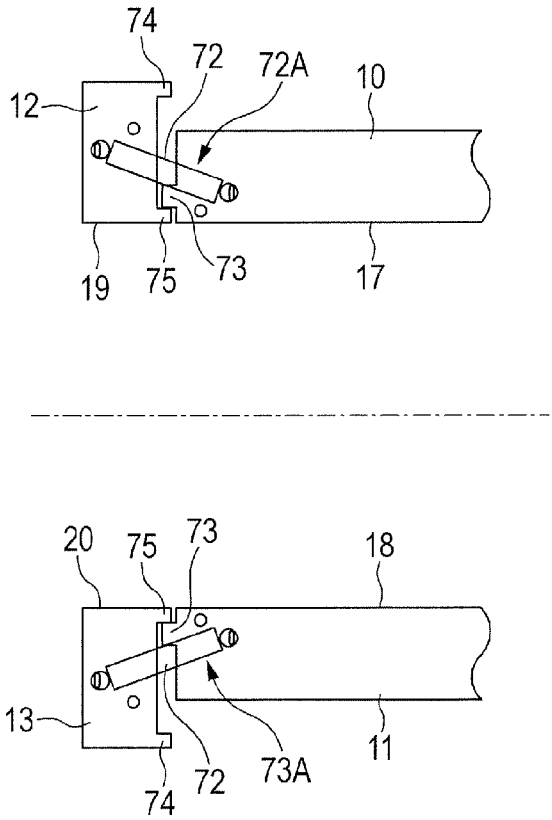
FIG. 11A illustrates toggle mechanisms for holding the far-side and near-side auxiliary side regulating members.
Figure 11B:
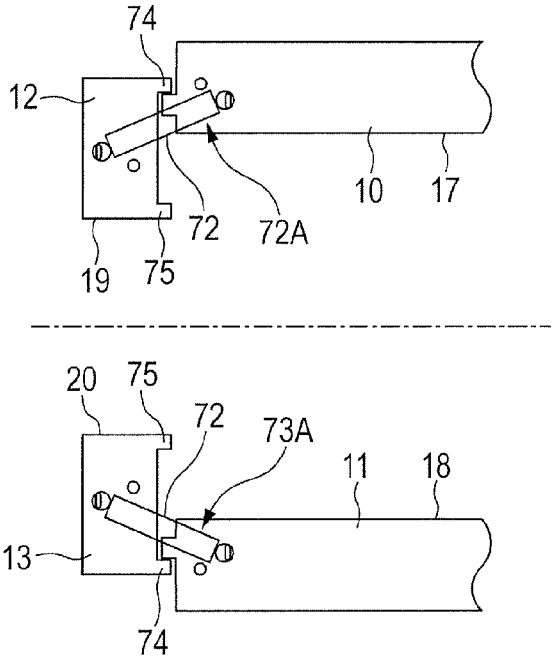
FIG. 11B illustrates the toggle mechanisms for holding the far-side and near-side auxiliary side regulating members.

In the second embodiment, as holding units for holding the far-side and near-side auxiliary side regulating members 12 and 13 at the positions corresponding to the sheet size, toggle mechanisms 72A and 73A illustrated in FIGS. 11A and 11B are used. As illustrated in FIGS. 11A and 11B, the toggle mechanisms 72A and 73A include stoppers 73 protruded on the far-side and near-side side regulating members 10 and 11, stoppers 74 and 75 protruded on the far-side and near-side auxiliary side regulating members 12 and 13, and tension springs 72.

The toggle mechanisms 72A and 73A move the far-side and near-side auxiliary side regulating members 12 and 13 to any one of the retreat positions and the protruding positions in acting directions of spring forces of the tension springs 72 along pivot trajectories of the link members 70 and 71. As illustrated in FIG. 11A, when the far-side and near-side auxiliary side regulating members 12 and 13 move to the retreat positions, the stoppers 75 are allowed to abut on the stoppers 73 of the far-side and near-side side regulating members 10 and 11, respectively, and thus the far-side and near-side auxiliary side regulating members 12 and 13 are held at the retreat positions. As illustrated in FIG. 11B, when the far-side and near-side auxiliary side regulating members 12 and 13 move to the protruding positions, the stoppers 74 are allowed to abut on the stoppers 73 of the far-side and near-side side regulating members 10 and 11, respectively, and thus the far-side and near-side auxiliary side regulating members 12 and 13 are held at the protruding positions.

In the second embodiment, by the toggle mechanisms 72A and 73A, the far-side and near-side auxiliary side regulating members 12 and 13 can be held after being moved to the positions corresponding to the sheet size. Thereby, when operating the far-side and near-side auxiliary side regulating members 12 and 13, the far-side and near-side auxiliary side regulating members 12 and 13 can be surely held at the positions corresponding to the sheet size. Therefore, the sheet can be surely guided. When using the toggle mechanisms 72A and 73A as in the second embodiment, an operational feeling becomes clear. Therefore, the far-side and near-side auxiliary side regulating members 12 and 13 can be surely moved to the retreat positions or the protruding positions.

Note that, though the embodiments have been described above while exemplifying the large-capacity paper deck 101 as the sheet feeding device, the present invention is not limited to such an example. For example, the present invention is also applicable to far-side and near-side side regulating members (not shown), which are provided in the sheet feed cassettes 233 or the open/close tray 300 of the printer main body 201A illustrated in FIG. 1. Moreover, though the embodiments have been described above on the configuration in which both of the pair of side edge regulating portions (far-side and near-side side regulating members 10 and 11) are movable in the width direction, the present invention is not limited thereto. The present invention is also applicable to a configuration in which one of the pair of side edge regulating portions is movable in the width direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-151085, filed Jul. 19, 2013, which is hereby incorporated by reference herein in its entirety.

What is claimed is:

1. A sheet feeding device, comprising:

a sheet feeding unit configured to feed a sheet;

a sheet containing unit configured to contain the sheet;

a sheet stacking unit configured to stack the sheet and provided in the sheet containing unit so as to be capable of being raised and lowered;

a pair of side edge regulating portions provided to be opposed to each other in the sheet containing unit so as to regulate side edge positions of the stacked sheet in a width direction orthogonal to a sheet feeding direction, at least one of the pair of side edge regulating portions being movable in the width direction;

auxiliary side edge regulating portions provided downstream of the pair of side edge regulating portions in the sheet feeding direction so as to be moved with the pair of side edge regulating portions in the width direction, and configured to form flush surfaces along the sheet feeding direction together with the pair of side edge regulating portions so as to regulate the side edge positions of the stacked sheet at retreat positions, the auxiliary side edge regulating portions being movable to the retreat positions and protruding positions, at which the auxiliary side edge regulating portions protrude in the width direction with respect to the pair of side edge regulating portions; and support units configured to support the auxiliary side edge regulating portions so that abutment surfaces of the auxiliary side edge regulating portions, which abut against the sheet, are movable in the width direction with respect to the pair of side edge regulating portions in a state of being parallel to the sheet feeding direction, wherein a distance between the abutment surfaces of the auxiliary side edge regulating portions at the protruding positions is narrower than a distance between the pair of side edge regulating portions in a state in which movement of the pair of side edge regulating portions in the width direction is regulated by the sheet stacking unit.

2. A sheet feeding device according to claim 1, further comprising holding units configured to hold the moved auxiliary side edge regulating portions at the retreat positions or the protruding positions.

3. A sheet feeding device according to claim 2, wherein the support units have pins formed on one of the pair of side edge regulating portions and the auxiliary side edge regulating portions, guide holes being formed on another of the pair of side edge regulating portions and the auxiliary side edge regulating portions along the width direction, and the pins engaged with the guide holes, and wherein the holding units have elastic members configured to elastically hold the pins when the auxiliary side edge regulating portions move to the one of the retreat positions and the protruding positions.

4. A sheet feeding device according to claim 2, wherein the support units are parallel link mechanisms configured to connect the pair of side edge regulating portions and the auxiliary side edge regulating portions to each other, and wherein the holding units have toggle mechanisms which include the parallel link mechanisms, springs, and stoppers configured to lock the auxiliary side edge regulating portions that have moved to one of the retreat positions and the protruding positions.

5. A sheet feeding device according to claim 4, wherein the parallel link mechanisms are arranged on upper surfaces and lower surfaces of the pair of side edge regulating portion and the auxiliary side edge regulating portions.

6. A sheet feeding device according to claim 5, wherein the arranged parallel link mechanisms are interlocked with shafts of link members of the parallel link mechanisms in the vicinity of the auxiliary side edge regulating portions.

7. A sheet feeding device according to claim 1, wherein the auxiliary side edge regulating portions are provided at positions facing the sheet feeding unit.

8. A sheet feeding device according to claim 1, wherein a downstream end of the sheet stacking unit in the sheet feeding direction has cutout portions configured to allow movement of the auxiliary side edge regulating portions under a state in which movement of the pair of side edge regulating portions in the width direction is regulated by the sheet stacking unit.

9. A sheet feeding device according to claim 1, wherein, when feeding the sheet having a length capable of being regulated by the pair of side edge regulating portions in the width direction, the auxiliary side edge regulating portions are moved to the retreat positions so as to regulate the side edge positions together with the pair of side edge regulating portions, and wherein, when feeding the sheet having a length shorter than the length capable of being regulated by the pair of side edge regulating portions in the width direction, the auxiliary side edge regulating portions are moved to the protruding positions so as to regulate the side edge positions by the auxiliary side edge regulating portions.

10. An image forming apparatus, comprising:

an image forming unit configured to form an image on a sheet; and the sheet feeding device according to claim 1, configured to feed the sheet to the image forming unit.

* * * * *